US007131246B2

(12) United States Patent
Dall'Omo et al.

(10) Patent No.: US 7,131,246 B2
(45) Date of Patent: Nov. 7, 2006

(54) APPARATUS FOR WRAPPING GROUPS OF ROLLS OF PRODUCTS WITH A SHEET OF PLASTIC FILM

(75) Inventors: Davide Dall'Omo, Bologna (IT); Christian Zagnoni, Calcara Di Crespellano (IT)

(73) Assignee: T.M.C. S.p.A., Bologna (IT)

( * ) Notice: Subject to any disclaimer, the term of this patent is extended or adjusted under 35 U.S.C. 154(b) by 0 days.

(21) Appl. No.: 11/109,293

(22) Filed: Apr. 19, 2005

(65) Prior Publication Data

US 2005/0229538 A1 Oct. 20, 2005

(30) Foreign Application Priority Data

Apr. 20, 2004 (IT) ..... BO2004A0230

(51) Int. Cl.
*B65B 51/14* (2006.01)
*B65B 49/08* (2006.01)
*B65B 11/22* (2006.01)

(52) U.S. Cl. ..... 53/376.7; 53/232; 53/377.8

(58) Field of Classification Search ..... 53/232, 53/233, 376.7, 377.8
See application file for complete search history.

(56) References Cited

U.S. PATENT DOCUMENTS 3,535,987 A * 10/1970 Morse et al. ..... 493/134
3,763,629 A * 10/1973 Carlstrom et al. ..... 53/370.3
4,805,375 A * 2/1989 Langen et al. ..... 53/142
6,067,780 A * 5/2000 Gentili et al. ..... 53/504
6,516,589 B1 * 2/2003 Draghetti et al. ..... 53/466
6,691,492 B1 * 2/2004 Gamberini ..... 53/230
2003/0230051 A1 12/2003 Tinti

* cited by examiner

*Primary Examiner*—John Sipos
(74) *Attorney, Agent, or Firm*—Fay, Sharpe, Fagan, Minnich & McKee, LLP

(57) ABSTRACT

An apparatus for wrapping groups of rolls of products with a sheet of film comprises a station for packaging and moving, with a stepping motion, in a predetermined direction, a succession of groups of products wrapped in a sheet of film, having an open front side defined by two opposite flaps, and means for closing the open side comprising a unit consisting of: two pairs of mobile elements, arranged side by side in said direction, to allow the flaps of film of the two groups of products arranged one after another to be brought together and closed; first movement means for the unit, allowing synchronized movement of the two pairs of elements, respectively, in the same direction as the groups, for one group feed step, bringing together and closing the flaps, and a movement opposite to said direction over a distance equal to the distance previously traveled, simultaneously with a feed step of the groups to be packaged, so as to position the unit at two further and subsequent groups of products to be closed.

13 Claims, 7 Drawing Sheets

APPARATUS FOR WRAPPING GROUPS OF ROLLS OF PRODUCTS WITH A SHEET OF PLASTIC FILM

BACKGROUND OF THE INVENTION

The present invention relates to an apparatus for wrapping groups of rolls of products with a sheet of plastic film to form a pack which preferably has a carry handle.

In particular, the present invention is for the production of packs or bundles containing a number of rolls and/or bundles with a rather high closing side.

Said packaging of groups of rolls of paper products, for example toilet or kitchen rolls, is performed using apparatuses designed (see also FIG. 1 which illustrates a known example of a pack):

- to automatically wrap sheets 2 of plastic film (such as polyethylene or the like) around the side surfaces of rolls R arranged in an orderly way in one or more rows;
- to then close the lower surface P1 of the bundle P by folding the end flaps of the sheet 2 of film over the bottom surfaces of the rolls R contained in the bundle P; and
- to seal the folded flaps together;
- to feed the partially closed pack, with a stepping motion, so as to fold the film on the front sides P2 and P3 of the pack and
- to seal the front sides to form the closed pack.

This method is implemented using known apparatuses comprising:

- a station for feeding individual rolls consisting of movement chutes and bars for pushing the rolls towards a
- station for collection of the rolls and formation of the group of products (single or multi layered and in several rows) consisting of an elevator which transfers the products received in an orderly way from the feed station to a
- packaging station, at a different level to the feed station and the elevator.

The elevator operates by means of a table which receives and transports products, which is horizontal and moves vertically between two end levels: the lower level being at the feed station and the upper level being at a section above for insertion of the products in the packaging station where the film is positioned horizontally so that it is intercepted by the products arriving and wraps around them.

Arranged vertically one after another after the sheet of film there are side folding hoppers and units which feed along the pack which is produced in stages, to obtain the first lower closure of the pack on the surfaces, as indicated above, using sealing bars and, in subsequent steps, also closing of the front of the pack.

It is possible to add to such apparatus, for example for bundles with dimensions such that they contain a large number of rolls, the application of a strip, again made of a plastic film, whose ends are fixed to the two sides of the bundle at one of the two front surfaces and whose length is such that it can be used as a handle for picking up and carrying the bundle.

An alternative for the production of "large" bundles, with sealed closure, preferably with the application of a bundle carry handle (automatically and at a cost lower than before) is illustrated in patent application BO2002A000392 by the Applicant, in which a method for creating a closure (with handle) on the packs is performed using an apparatus comprising two plates, which move vertically in opposite directions to bring together the opposite flaps of the sheet of plastic film at one of the two front surfaces of the bundle. These plates keep the flaps stretched out relative to one another with the possibility of sliding at a tangent to the plates, whilst pusher means neatly push the material of the side surfaces of the sheet located between the flaps into the space between the two flaps, gradually as they are brought together.

The plates are also equipped with sealing means for joining the two flaps once they have been brought together, and means designed to make an opening in the surface at which the two flaps are joined, so as to form a handle where necessary.

Said system therefore allows the bundle to be sealed and closed during the stepping feed of the bundle supporting teeth unit, if necessary forming the carry handle by adding, at the side of the path followed by the teeth, a pair of mobile plates on either side of the path to perform said closing.

However, now the current machines producing "standard" bundles have high productivity in terms of time, with consequent greatly reduced dwell periods for pressing the film, sealing and if necessary creating the handle opening, not sufficient to allow said operation. This is because a strictly predetermined time is required, in which at least the packaging station, therefore the conveyor teeth, must be in the dwell state.

Therefore, said factor would limit the maximum productivity of the machine.

SUMMARY OF THE INVENTION

The aim of the present invention is therefore to overcome these disadvantages by providing an apparatus for wrapping groups of rolls of products with a sheet of plastic film to form a pack with a carry handle, of the extremely safe type, with a high quality end product, maintaining a high level of general machine productivity, without altering its construction architecture.

Accordingly, said aim is achieved by an apparatus for wrapping groups of rolls of products with a sheet of film comprising a station for packaging and moving, with a stepping motion, in a predetermined direction, a succession of groups of products wrapped in a sheet of film, having an open front side defined by two opposite flaps, and means for closing the open side comprising a unit consisting of: two pairs of mobile elements, arranged side by side in the above-mentioned direction, to allow the flaps of film of two groups of products arranged one after another to be brought together and closed; first movement means for the unit allow synchronized movement of the two pairs of elements, respectively, in the same direction as the groups, for one group feed step, bringing together and closing the flaps, and a movement opposite to said direction over a distance equal to the distance previously traveled, simultaneously with a feed step of the groups to be packaged, so as to position the unit at two further and subsequent groups of products to be closed.

BRIEF DESCRIPTION OF THE DRAWINGS

The technical features of the present invention, in accordance with the above-mentioned aims, are set out in the claims herein and the advantages more clearly illustrated in the detailed description which follows, with reference to the accompanying drawings, which illustrate a preferred embodiment of the invention without limiting the scope of the inventive concept, and in which:

DESCRIPTION OF THE PREFERRED EMBODIMENTS

Figure 1:
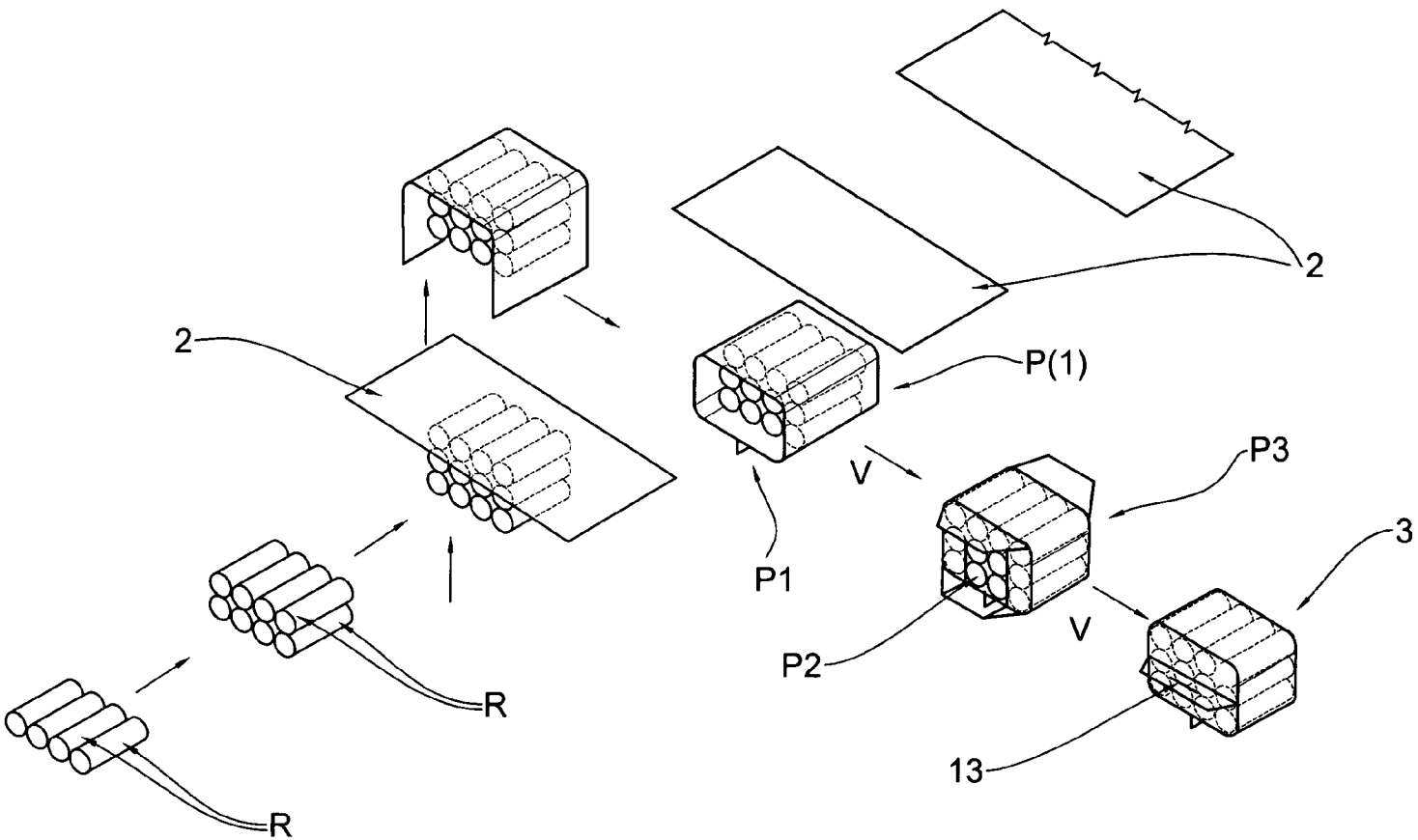
FIG. 1 is a perspective view of a known type of pattern for wrapping groups of products.

With reference to the accompanying drawings, and in particular with reference to FIGS. 1 to 5, the apparatus disclosed, labeled 4 as a whole, is used to wrap groups 1 of rolls of products with a sheet 2 of film to form a pack 3 which has the shape of a prism.

In particular, the apparatus 4 disclosed may be used to produce packs 3 of rolls of paper for example, but without limiting the scope of the invention, toilet or kitchen rolls.

As illustrated in the accompanying drawings, the packs 3 have dimensions which are such that they contain a large number of rolls and may also, without limiting the scope of the invention, have a carry handle.

The apparatus 4 comprises, at least in the parts which form the subject matter of this description:

- a station 5 for packaging and moving with a stepping motion, in a predetermined direction (indicated by the arrows V), a succession of ready-formed groups 1 of products wrapped in a sheet 2 of film with at least one front side P2 (also visible in FIG. 1) open and defined by two opposite flaps 2*a*, 2*b* of the sheet 2;
- means 6 for closing at least the open side P2, acting on the two flaps 2*a*, 2*b* of film.

This description does not specify any stations for forming the groups 1 of products, since they are of the known type and not strictly part of the invention.

Figure 4:
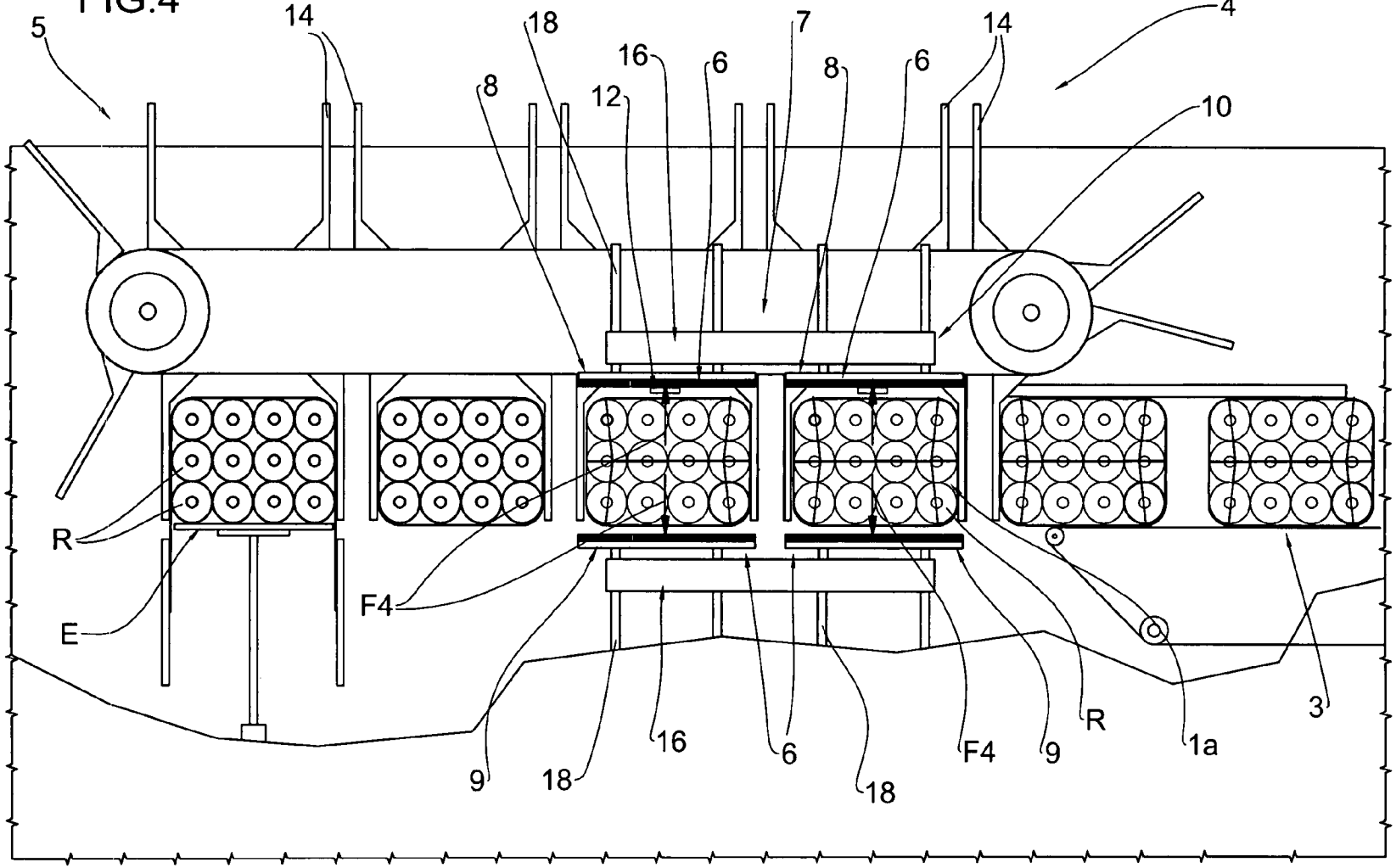
Figure 5:
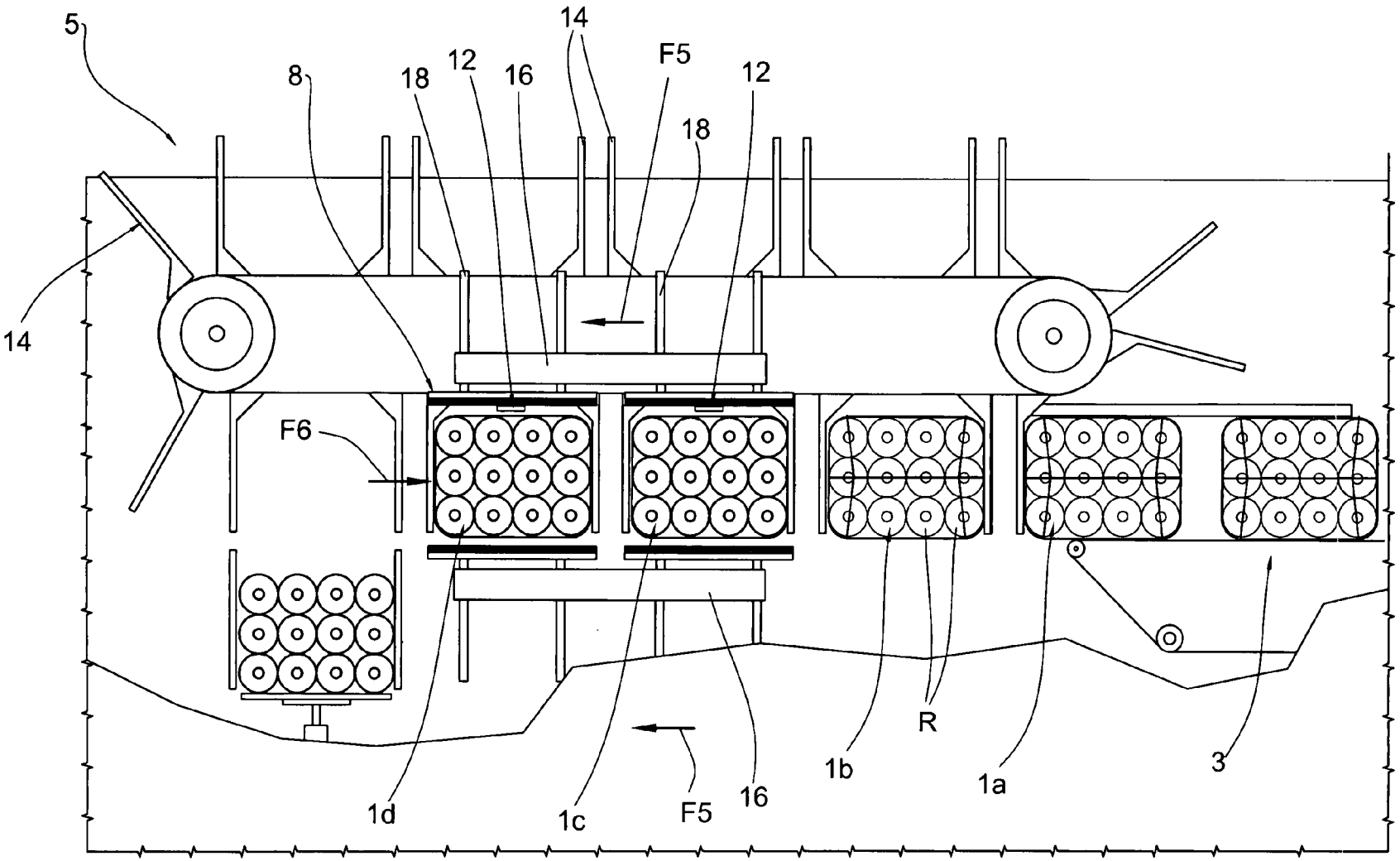

As illustrated in FIGS. 2 to 5, the closing means 6 comprise a unit 7, located at the side of the packaging station 5 and consisting of:

- two pairs 8 and 9 of elements mobile along a vertical plane, alongside one another in the predetermined direction V, and designed to allow the relative pairs of flaps 2*a*, 2*b* of film of the two groups 1*a*, 1*b* of products positioned one after another to be brought together and closed;
- first means 10 for moving the unit 7, acting on the unit 7 in such a way as to allow synchronized movement of the two pairs 8, 9 of elements, respectively in the same predetermined direction V as the groups 1*a*, 1*b* (see FIGS. 2 and 3), for a group 1 feed step, bringing the flaps 2*a*, 2*b* of the pairs of groups 1*a*, 1*b* together and closing them, and a movement opposite to said predetermined direction V over a distance equal to the distance previously traveled, simultaneously with a feed step of the groups 1 to be packaged, so as to position the unit 7 at two further and subsequent groups 1*c*, 1*d* of products to be closed (see FIGS. 4 and 5).

Figure 2:
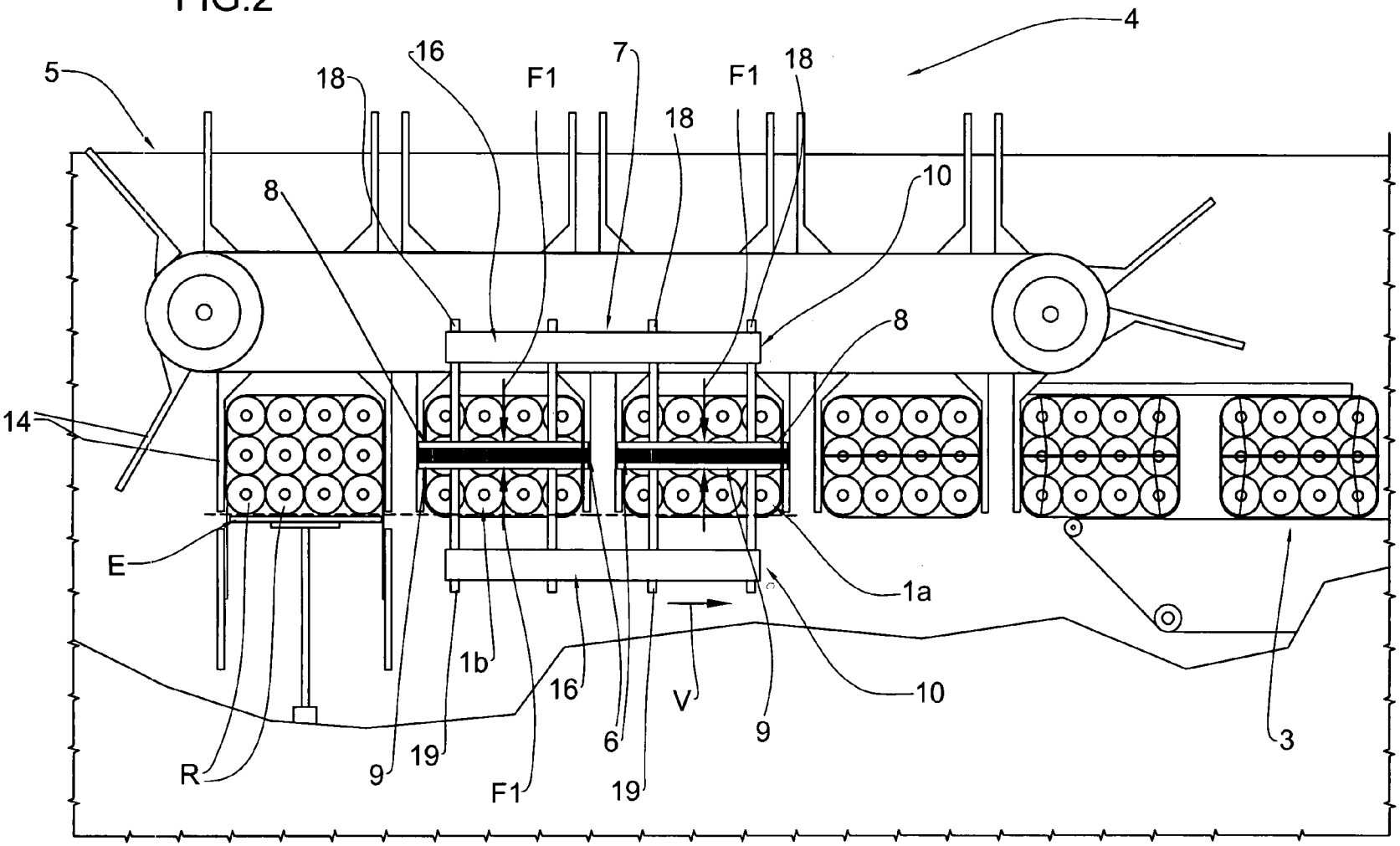
FIGS. 2 to 5 are schematic side views with some parts cut away to better illustrated others of a corresponding set of successive operations which can be performed by an apparatus for wrapping groups of rolls of products with a sheet of film according to the present invention.
Figure 3:
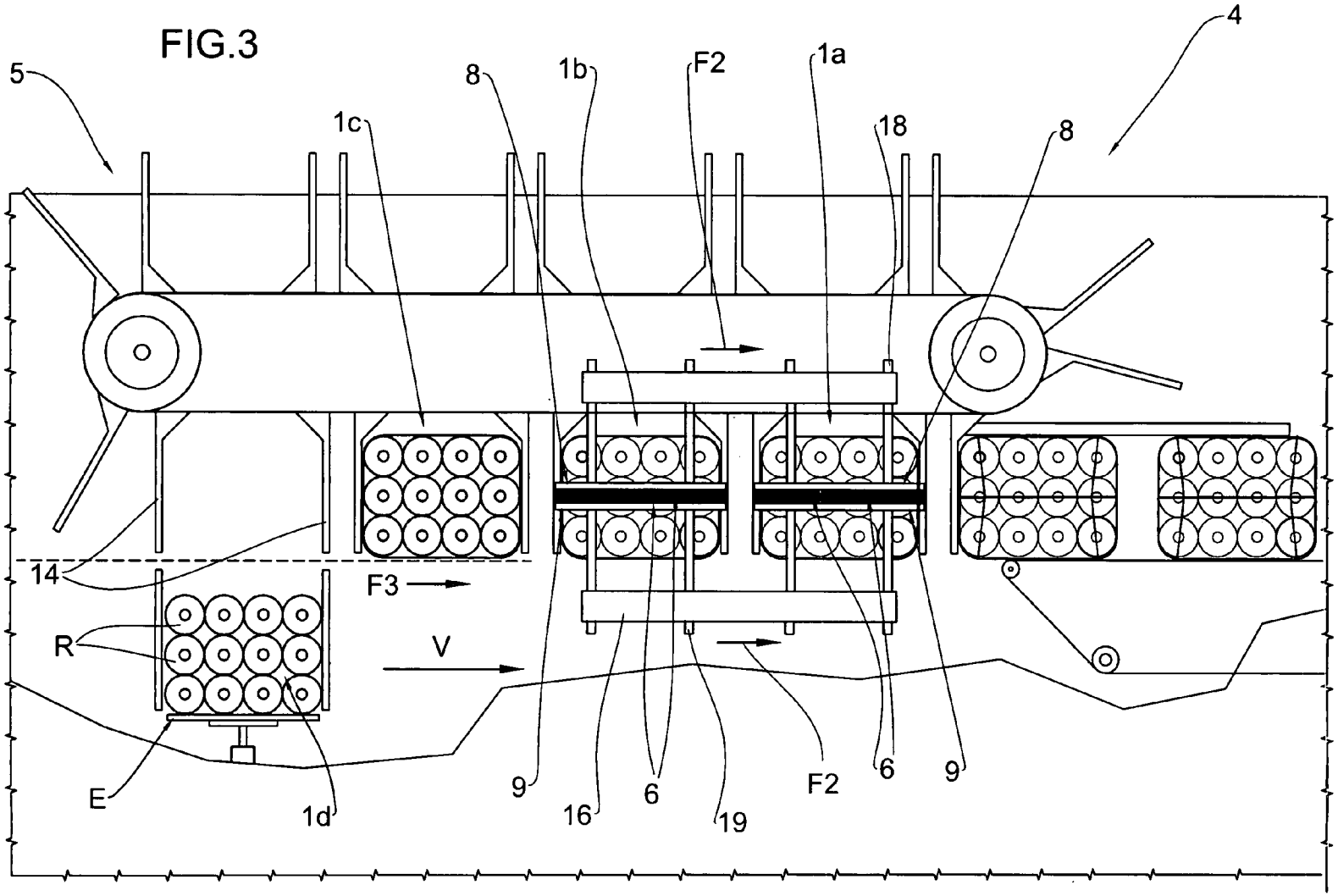

More precisely, to achieve these movements, the pairs 8, 9 of elements are fitted with second movement means 11 located on the unit 7 and designed to allow pairs of elements 8, 9 to move towards one another to close the flaps 2*a*, 2*b* of the two groups 1*a*, 1*b* of products simultaneously with the formation, upstream of the unit 7 relative to the predetermined direction V, of a subsequent group 1*c* of products wrapped in a sheet 2 of film (see FIG. 2).

Examining the features of the unit 7 in more detail, the second movement means 11 are connected to and synchronized with the first movement means 10 for the unit 7, to allow several positions of mobile elements 8, 9, respectively for:

- defining and maintaining a position in which the pairs of mobile elements 8, 9 (arrows F1) move towards one another to close the flaps 2*a*, 2*b* of the pair of groups 1*a*, 1*b* of products when the unit 7 moves one step (see arrows F2), and simultaneously with the feeding of the subsequent group 1*c* (see arrow F3) of products wrapped, with relative formation and wrapping of another group 1*d* of products with a sheet 2 upstream of the previous group 1*c* of ready-wrapped products (see FIG. 3);
- movements of the pairs of mobile elements 8, 9 away from one another (see arrows F4) with movement opposite to the predetermined direction V over a distance equal to the distance previously traveled (see arrows F5), and simultaneously with a feed step of the two groups 1*c*, 1*d* formed and wrapped to be packaged (see arrows F6) so as to position the unit 7 at the latter two further and subsequent groups 1*c*, 1*d* of products to be closed.

Preferably, but without limiting the scope of the invention, each pair of mobile elements 8, 9 may be equipped with means 12 for creating at least a partial opening 13 which forms a carry handle on each group 1 of products wrapped simultaneously with its closure (the handle is visible in FIG. 1 and consists, for example, of an incision).

As is clearly illustrated in FIGS. 2 to 5, the packaging station 5 consists of opposite units 14 consisting of teeth for holding and feeding the side ends of each group 1 of products formed and arriving from an elevator E.

Figure 6:
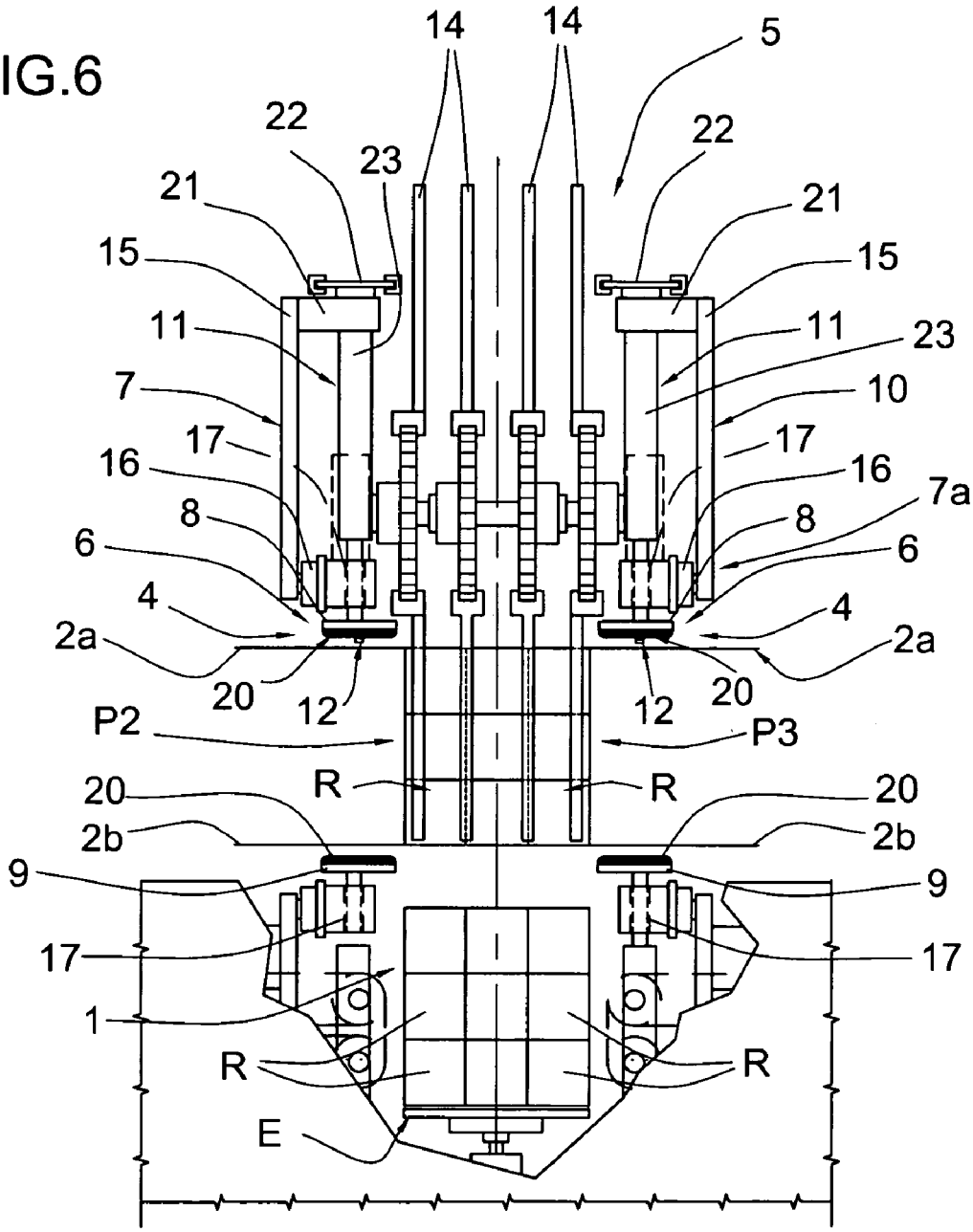
FIGS. 6 and 7 are schematic front views with some parts cut away to better illustrate others of the apparatus illustrated in the previous figures in two different operating configurations.
Figure 7:
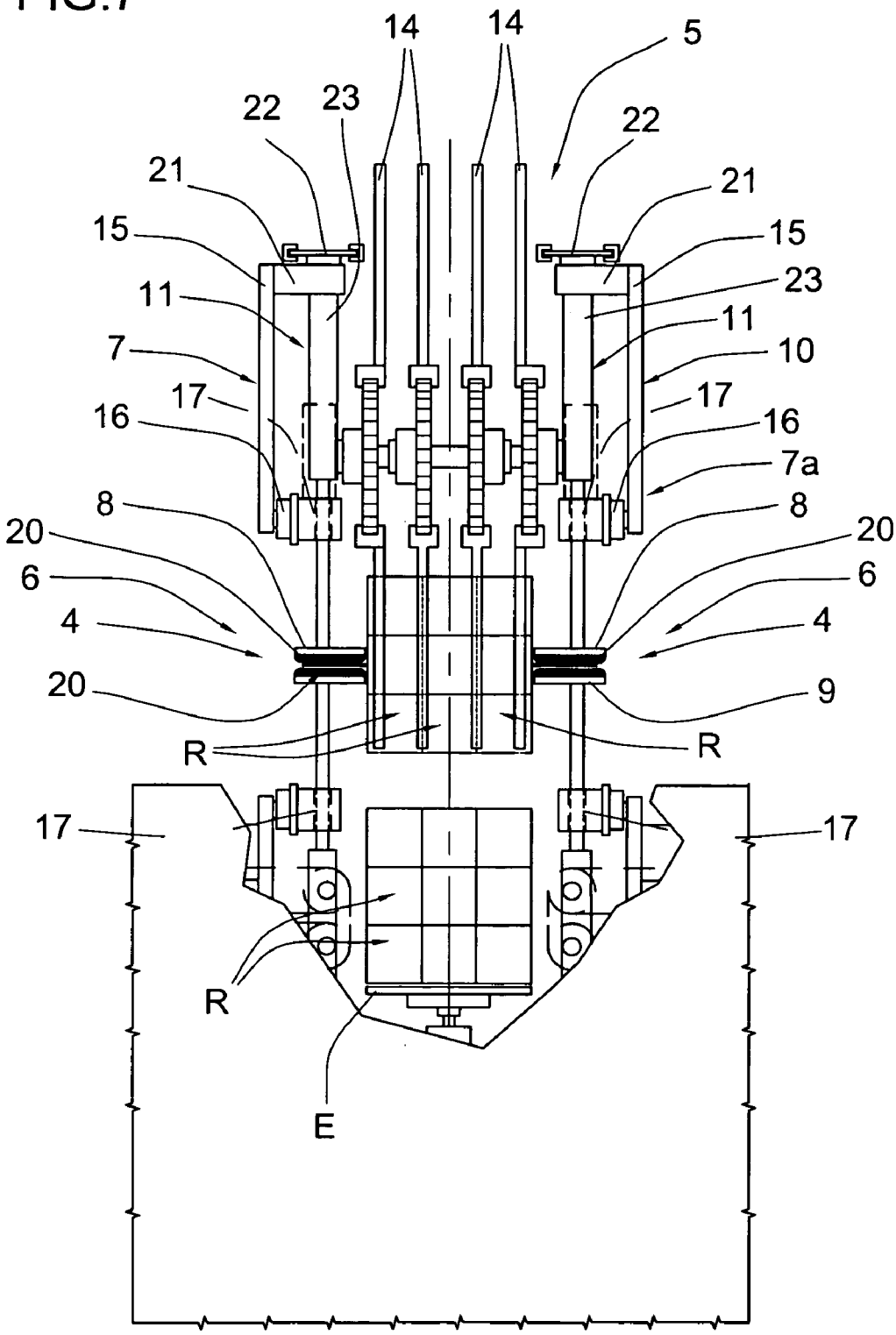

These feed units 14 allow the groups 1 to be moved with a stepping motion, with both front sides P2, P3 open and with relative flaps 2*a*, 2*b* of film (see also FIGS. 6 and 7).

With such a structure, the apparatus 4 comprises two of the above-mentioned units 7 and 7*a*, located on either side of the groups 1 of products wrapped as they are fed forward, each unit having two pairs of the mobile elements 8, 9 for synchronized closing of both sides of the pairs of groups 1*a*, 1*b* of products wrapped.

In this specific case at least one of the two units 7, 7*a* has a pair of mobile elements 8, 9 equipped with means 12 for creating at least a partial opening 13 which forms a carry handle on each group 1 of products wrapped, simultaneously with group closing.

At a structural level, each unit 7 comprises a first supporting frame 15 consisting of a supporting beam 16 for each mobile element 8, 9, connected to the first movement means 10.

On each of the beams 16 extending horizontally there are slidably attached, in relative bushing seats 17, a plurality of rods 18, 19, which move the mobile elements 8, 9 in both directions and form the above-mentioned second movement means 11.

Each mobile element 8, 9 consists of a plate with at least heat generating means 20 designed to allow the ends of the flaps 2*a*, 2*b* of film to be sealed closed when each pair of mobile elements 8, 9 is brought together.

At least two of the pairs of plates 8, 9 may be equipped with the means 12 for creating an opening which, for example, may be means for punching a zone 13 of the sealed film to produce at least a partial through-opening which forms the handle.

Each of the beams 16 may be supported by a second frame 21 slidably mobile along longitudinal guides 22 extending parallel with the predetermined direction V of the groups 1 of products, guides 22 basically consisting of the first movement means 10.

The second movement means 11 may comprise cylinders 23 which move each of the mobile elements 8, 9 (schematically illustrated in FIGS. 6 and 7) in both directions, allowing their synchronized movement towards and away from one another.

Therefore, an apparatus structured in this way fully achieves the preset aims thanks to simple and effective application of a sealing unit synchronized with the rest of the machine.

The possibility of simultaneously performing two complete closing operations, combined with a succession of unit stepping movements in the same direction as and opposite the normal operating movement of the packaging unit allows both high quality closing, which may also include a carry handle, and fast operation suited to the high production speeds of the wrapping unit.

Therefore, the closing cycle is made safe, reliable and very fast without affecting the machine construction architecture, dimensions and, therefore, overall costs of the machine.

The invention described is suitable for evident industrial applications and may be subject to modifications and variations without thereby departing from the scope of the inventive concept. Moreover, all details of the invention may be substituted by technically equivalent elements.

The invention claimed is:

1. An apparatus for wrapping groups of rolls of products with a sheet of film to form a pack which has the shape of a prism; the apparatus comprising at least:

a station for packaging and moving with a stepping motion in a predetermined direction, a succession of groups of products wrapped in a sheet of film, having at least one front side open and defined by two opposite flaps;

means for closing the open side, acting on the two flaps of film, the closing means comprising a unit located at the side of the packaging station and comprising:

two pairs of elements mobile along a vertical plane, alongside one another in the predetermined direction, and designed to allow the relative pairs of flaps of film of the two groups of products positioned one after another to be brought together and closed;

first movement means for the unit, acting on the unit to allow synchronized movement of the two pairs of elements, respectively, in the same predetermined direction as the groups, for one group feed step, bringing together and closing the flaps of the pairs of groups, and a movement opposite to said predetermined direction over a distance equal to the distance previously traveled, simultaneously with a feed step of the groups to be packaged, positioning the unit at two further and subsequent groups of products to be closed.

2. The apparatus according to claim 1, wherein the pairs of elements have second movement means located on the unit and designed to allow the pairs of elements to move towards one another to close the flaps of the two groups of products simultaneously with the formation, upstream of the unit relative to the predetermined direction, of a subsequent group of products wrapped in a sheet of film.

3. The apparatus according to claim 2, wherein the second movement means are connected to and synchronized with the unit first movement means, defining and maintaining a position in which the mobile elements move towards one another to close the flaps of the pair of groups of products when the unit moves one step, and simultaneously with feed of the subsequent group of products wrapped, with relative formation and wrapping of another group of products with a sheet upstream of the previous group of products wrapped.

4. The apparatus according to claim 2, wherein the second movement means are connected to and synchronized with the unit first movement means, to allow several positions of mobile elements respectively for:

defining and maintaining a position in which the mobile elements move towards one another to close the flaps of the pair of groups of products when the unit moves one step, and simultaneously with feed of the subsequent group of products wrapped, with relative formation and wrapping of another group of products with a sheet upstream of the previous group of products wrapped;

movements of the pairs of mobile elements away from one another with relative movement opposite to the predetermined direction over a distance equal to the distance previously traveled, and simultaneously with a feed step of the two groups formed and wrapped to be packaged so as to position the unit at the latter two further and subsequent groups of products to be closed.

5. The apparatus according to claim 1, wherein each pair of mobile elements is equipped with means for creating at least one partial opening which forms a carry handle on each group of products wrapped simultaneously with its closure.

6. The apparatus according to claim 1, wherein the packaging station comprises opposite units of teeth for holding and feeding the side ends of each group of products and for moving, with a stepping motion, the groups with both front sides open and with relative flaps of film, comprising two closing units located on either side of the groups of products wrapped as they are fed forward, each closing unit having two pairs of the mobile elements for synchronized closing of both sides of the pairs of groups of products wrapped.

7. The apparatus according to claim 6, wherein at least one of the closing units has a pair of mobile elements equipped with means for creating at least a partial opening which forms a carry handle on each group of products wrapped, simultaneously with group closing.

8. The apparatus according to claim 2, wherein the closing unit comprises a first supporting frame comprising a supporting beam for each mobile element, connected to the first movement means; on each of the beams extending horizontally there being slidably attached, in relative bushing seats, a pair of rods which move the mobile elements in both directions and forming the above-mentioned second movement means.

9. The apparatus according to claim 1, wherein each mobile element comprises a plate with at least heat generating means designed to allow the ends of the flaps of film to be sealed closed when each pair of mobile elements is brought together.

10. The apparatus according to claim 8, wherein each pair of plates has means for punching a sealed zone of film to create at least a partial through-opening which forms a handle.

11. The apparatus according to claim 8, wherein each beam is supported by a second frame slidably mobile along longitudinal guides extending parallel with a predetermined direction of the groups of products and forming the first movement means.

12. The apparatus according to claim 8, the second movement means comprising cylinders for moving each mobile element in both directions.

13. The apparatus according to claim 8, wherein each mobile element comprises a plate with at least heat generating means designed to allow the ends of the flaps of film to be sealed closed when each pair of mobile elements is brought together.

* * * * *